US005343810A

United States Patent [19]

Theurer

[11] Patent Number: 5,343,810

[45] Date of Patent: Sep. 6, 1994

[54] SWITCH TAMPER

[75] Inventor: Josef Theurer, Vienna, Austria

[73] Assignee: Franz Plasser Bahnbaumaschinen-Industriegesellschaft M.B.H., Vienna, Austria

[21] Appl. No.: 90,808

[22] Filed: Jul. 12, 1993

[30] Foreign Application Priority Data

Aug. 12, 1992 [AT] Austria ..... 1624/92

[51] Int. Cl.[5] ..... E01B 27/00

[52] U.S. Cl. ..... 104/12; 104/7.1

[58] Field of Search ..... 104/2, 12, 7.1, 7.2

[56] References Cited

U.S. PATENT DOCUMENTS

| | | | |
|---|---|---|---|
| 3,608,497 | 9/1971 | Plasser | 104/12 |
| 3,669,025 | 6/1972 | Plasser et al. | 104/12 |
| 4,625,651 | 12/1986 | Theurer | 104/7.2 |
| 4,646,645 | 3/1987 | Theurer | 104/12 |
| 4,733,614 | 3/1988 | Mohr et al. | 104/12 |
| 4,825,768 | 5/1989 | Theurer et al. | 104/7.2 |
| 4,893,565 | 1/1990 | Theurer et al. | 104/7.2 |
| 5,031,542 | 7/1991 | Theurer | 104/12 |
| 5,142,988 | 9/1992 | Ganz | 104/7.1 |

*Primary Examiner*—Mark T. Le
*Attorney, Agent, or Firm*—Collard & Roe

[57] ABSTRACT

A switch tamping machine comprises a machine frame, a track lifting and lining unit operated by lifting and lining drives linking the track lifting and lining unit to the machine frame, and at least one ballast tamping unit mounted on the machine frame for displacement transversely to the direction of elongation of the machine frame. The tamping unit comprises a carrier frame, a tamping tool carrier vertically adjustably mounted on the carrier frame for vertical displacement along a vertical guide, and a pair of vibratory tamping tools mounted on the tamping tool carrier for reciprocation in the direction of elongation. An auxiliary lifting device is vertically adjustably mounted on the carrier frame of the transversely displaceable tamping unit for lifting a switch rail transversely spaced from the machine frame, the auxiliary lifting device comprising a vertically adjustable rail engaging tool, and a lifting drive links the auxiliary lifting device to the carrier frame.

10 Claims, 2 Drawing Sheets

Fig. 1
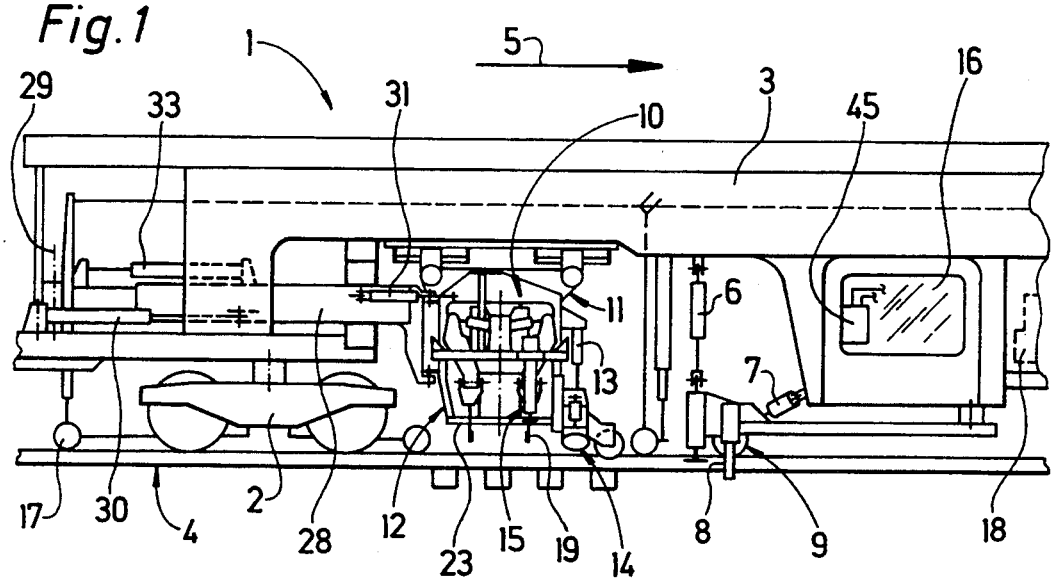
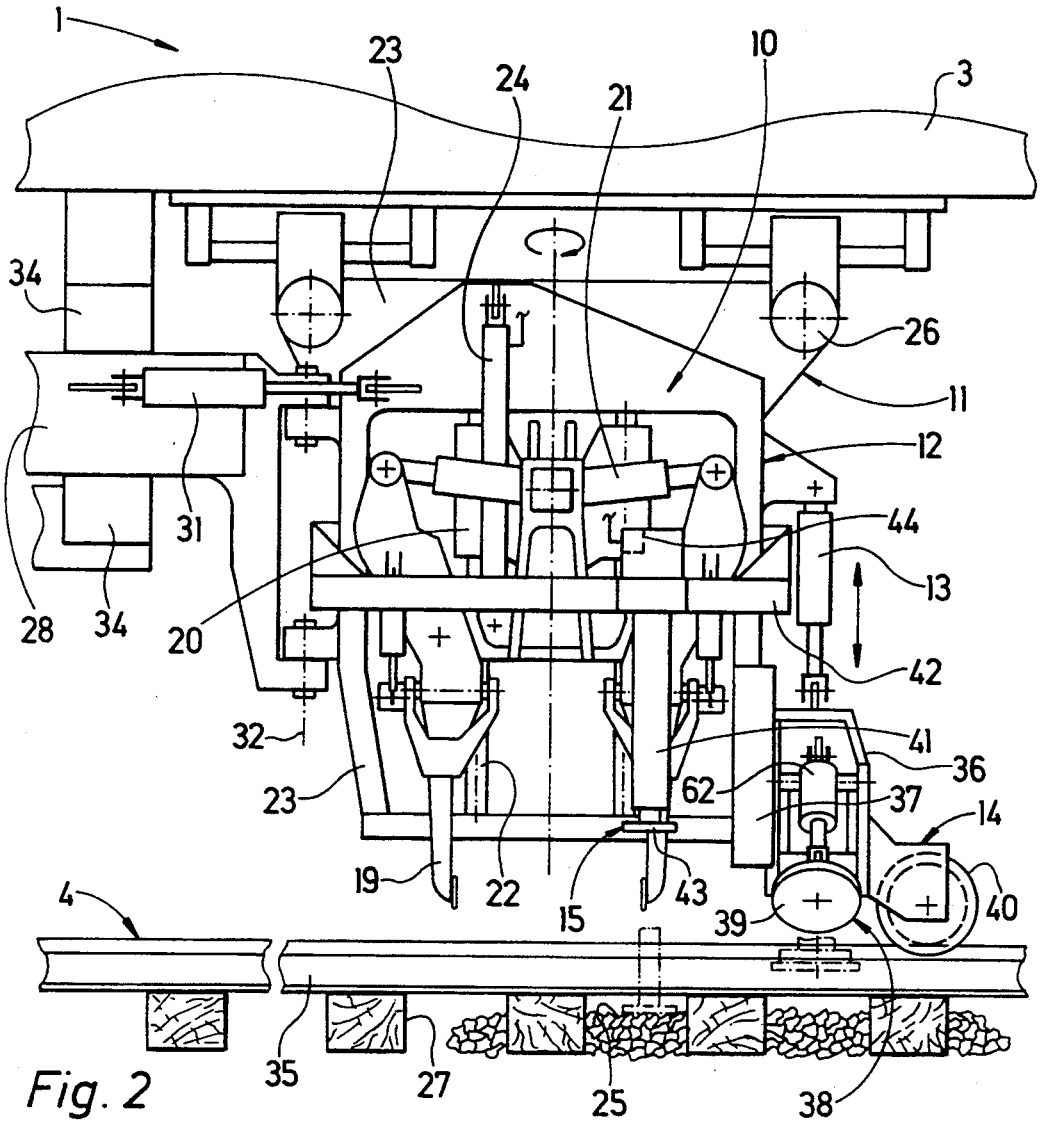
Fig. 2

Fig. 3
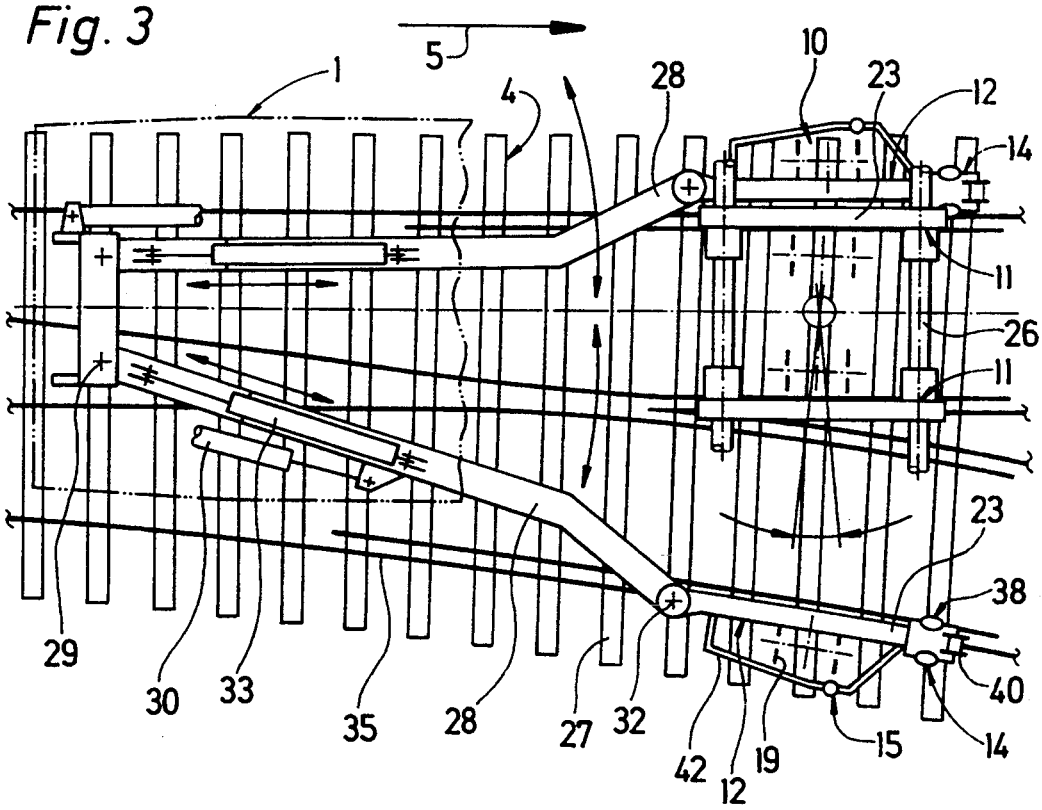
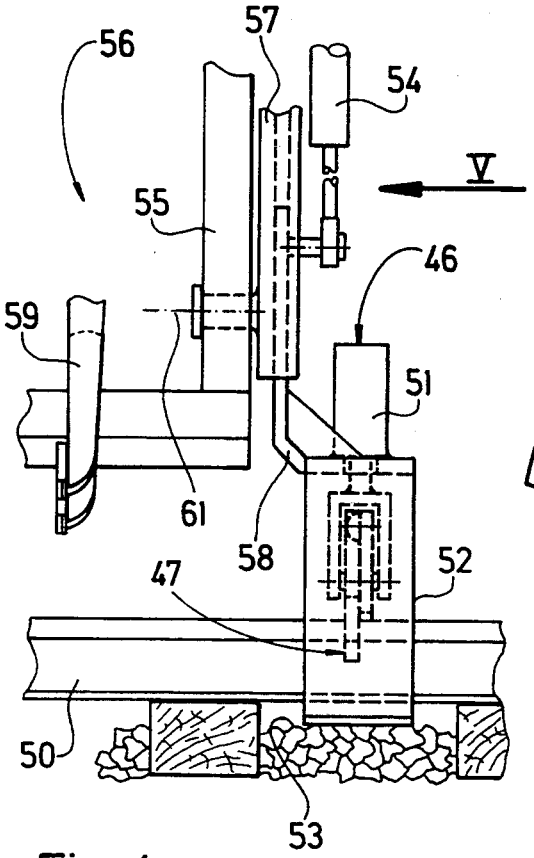
Fig. 4
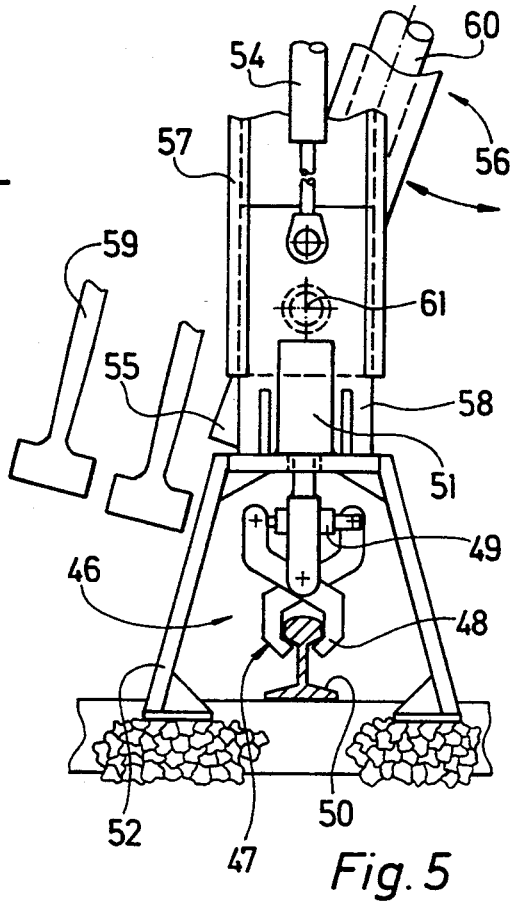
Fig. 5

SWITCH TAMPER

BACKGROUND OF THE INVENTION

1. Field of the Invention

The present invention relates to a switch tamping machine comprising a machine frame extending in a direction of elongation and supported on undercarriages for mobility on a track resting on ballast, a track lifting and lining unit, lifting and lining drives linking the track lifting and lining unit to the machine frame between the undercarriages, and at least one ballast tamping unit mounted on the machine frame for displacement transversely to the direction of elongation. The tamping unit comprises a carrier frame, a tamping tool carrier vertically adjustably mounted on the carrier frame for vertical displacement along vertical guide means, and a pair of vibratory tamping tools mounted on the tamping tool carrier for reciprocation in the direction of elongation. The switch tamping machine further comprises an auxiliary lifting device for lifting a switch rail transversely spaced from the machine frame, the auxiliary lifting device comprising a vertically adjustable rail engaging tool.

2. Description of the Prior Art

U.S. Pat. No. 5,031,542 discloses such a mobile ballast tamping machine designed especially for operation in switches and rail crossings. Switch work is difficult not only because of the complicated rail configuration in the switch area but particularly because of the heavy weight of track switches due to the fact that the main track is connected to the branch track in this area by long ties. This heavy weight tends to result in inaccuracies during the lifting and lining of the track switch, particularly in view of the fact that the weight is asymmetrically distributed.

The machine disclosed in this patent comprises an elongated machine frame supported on two undercarriages wherebetween lifting and lining drives link a track lifting and lining unit to the machine frame. Four independently transversely adjustable tamping units are mounted on the machine frame rearwardly of the lifting and lining unit in transverse alignment, each tamping unit carrying a pair of vibratory tamping tools reciprocable in the direction of elongation of the machine frame for respectively operating on the gage and field sides of each track rail. Each tamping unit comprises a carrier frame and a tamping tool carrier vertically adjustably mounted thereon. The transverse adjustment of the tamping units enables selected units to be used for tamping the rails of a branch line in the switch area. Either all four or only the two outer tamping units are mounted on the free ends of elongated carrier beams whose opposite ends are pivoted to the machine frame for pivoting about a vertical axis for transverse adjustment of the tamping units. Furthermore, an auxiliary rail lifting device is mounted on the machine frame adjacent the track lifting and lining unit for lifting a branch track rail in a switch laterally adjacent the machine frame. This auxiliary lifting device comprises a frame running on the branch track rail and carrying rail gripping tools, and a pull rod links the auxiliary lifting device frame to the machine frame. Furthermore, a rope connects the auxiliary lifting device frame to a telescopingly extensible carrier arm on top of the machine frame, and a vertical lifting drive connected to the rope enables the auxiliary lifting device to lift the branch track rail. The carrier arm may be horizontally turned 180° so that the auxiliary lifting device may be operated at either side of the machine frame.

The mobile track switch working machine disclosed in U.S. Pat. No. 4,893,565 also has vertically adjustable tamping units and a track lifting and lining unit having flanged wheels running on the track rails and rail gripping lifting hooks and rollers for engaging the rails. An auxiliary rail lifting device is connected to the track lifting and lining unit at each side of the machine frame and comprises a telescopingly extensible carrier arm extending transversely to the machine frame. A rail lifting hook is mounted at the free end of each carrier arm for selective engagement with the rail head or foot of a branch track rail in a track switch, and a vertically adjustable support jack is associated with the rail lifting hook to support the free carrier frame end on the ballast in a crib and to provide an additional lifting force.

SUMMARY OF THE INVENTION

It is the primary object of this invention to provide a switch tamping machine of the first-described type with an auxiliary rail lifting device of simple construction and high economy of space, which may be put into operation rapidly and without problems.

The above and other objects and advantages are accomplished according to the invention with an auxiliary rail lifting device which is vertically adjustably mounted on the carrier frame of the transversely displaceable tamping unit by means of a lifting drive.

Such an arrangement enables the switch tamping machine to be put into operation at a minimum of time, i.e. very economically, while at the same time enhancing the quality of the lifting operation. The conventional working of track switches entails running the ballast tamping machine on the main track to tamp the same while the outer tamping unit is moved laterally to the branch track in the switch area to tamp the branch track rail while the auxiliary lifting device raises the same. This prevents tilting of the switch and holds and fixes it in a geometrically proper position. The mounting of the auxiliary rail lifting device directly on the tamping unit used for tamping the branch track rail has the great advantage that lifting is effected at the strategically most favorable point, i.e. as close as possible to the tamping. Furthermore, this arrangement does away with the costly and complicated telescopingly extensible carrier arm for the auxiliary lifting device. Instead, the transverse displacement of the tamping unit automatically places the auxiliary lifting device in its operating position so that the operator in the operating cab can immediately actuate the lifting operation by remote control. No time-consuming, manual preparatory work is required and the auxiliary lifting device is moved into its rest position simply by actuating the lifting drive.

According to a preferred embodiment, a vertical guide is provided on the carrier frame for vertically adjustably mounting the auxiliary lifting device thereon, the vertical guide extending parallel to the vertical guide means, and the auxiliary lifting device further comprises a drive for adjusting the rail engaging tool. In this way, even if the switch is very heavy, a centering of the tamping unit carrier frame with respect to the branch track rail will automatically center the rail engaging lifting tool relative to this rail.

If the auxiliary lifting device further comprises a double-flanged roller vertically adjustable with the auxiliary lifting device by the lifting drive for engagement with the switch rail, the carrier frame with the rail engaging tool of the auxiliary lifting device will be automatically centered over the branch track rail. Furthermore, the double-flanged roller enables the auxiliary rail lifting device to be readily placed on the branch track rail by remote control.

In accordance with another preferred embodiment, the machine further comprises a support jack mounted on the carrier frame for adjustment parallel to the vertical guide means, the jack including a support plate for engagement with the ballast upon vertical adjustment of the jack. This will advantageously relieve the carrier frame and the machine frame on which it is mounted from the tilting stress exerted by the asymmetrical lifting of the branch track rail and will transmit this stress to the ballast. Preferably, the support jack is arranged transversely to the direction of elongation laterally adjacent one of the tamping tools on a side of the tamping unit facing away from the machine frame so that the support jack is automatically placed in a crib adjacent the pair of tamping tools straddling an adjacent tie.

If the support jack comprises an hydraulic drive including a hydraulic fluid pressure control valve, the pressure in the jack can be suitably adjusted so that it will optimally support the carrier frame on the ballast without lifting it. Preferably, a control is provided for automatically operating the support jack in conjunction with the vertical adjustment of the tamping tool carrier to simplify the operation.

Advantageously, the lifting drive linking the lifting and lining unit to the machine frame and the lifting drive linking the auxiliary lifting device to the carrier frame are synchronously operable, which simply assures that the switch with its long ties does not tilt during lifting, thus dependably avoiding additional and undesired stress on the rail fastening elements and other track components.

In accordance with yet another embodiment, the auxiliary lifting device further comprises a support frame vertically adjustable on the carrier frame by the lifting drive for the auxiliary lifting device, the support frame straddling the switch rail to be lifted and engaging with the ballast upon vertical adjustment thereof, and a further drive is mounted on the support frame for vertically adjusting the rail engaging tool. Preferably, the lifting device is mounted on the carrier frame for pivoting about an axis extending in the direction of elongation perpendicularly to the vertical guide means. This embodiment is particularly useful in tamping machines in which the transverse displacement of the tamping units is effected by pivoting about a horizontal axis extending parallel to the direction of elongation of the machine frame.

BRIEF DESCRIPTION OF THE DRAWING

The above and other objects, advantages and features of the present invention will become more apparent in the following detailed description of certain now preferred embodiments thereof, taken in conjunction with the accompanying somewhat schematic drawing wherein FIG. 1 is a fragmentary side elevational view of a switch tamping machine according to this invention, the generally conventional front portion and front undercarriage of the machine not being shown;

FIG. 2 is an enlarged fragmentary side elevational view of the tamping unit with the auxiliary rail lifting device according to the invention;

FIG. 3 is a diagrammatic top view of a switch area and the positioning of the tamping units in this area;

FIG. 4 is an enlarged fragmentary side view of another embodiment of the auxiliary rail lifting device; and FIG. 5 is an end view of the auxiliary rail lifting device, seen in the direction of arrow V in FIG. 4.

DETAILED DESCRIPTION OF PREFERRED EMBODIMENTS

Referring now to the drawing and first to FIGS. 1 to 3 there is shown switch tamping machine 1 comprising machine frame 3 extending in a direction of elongation and supported on undercarriages for mobility on track 4 resting on ballast 25. FIG. 1 shows only rear undercarriage 2 and the machine is advanced in an operating direction indicated by arrow 5. In a conventional manner, track lifting and lining unit 9 is mounted on machine frame 3 between the undercarriages, and lifting and lining drives 6, 7 link track lifting and lining unit 9 to the machine frame between the undercarriages. The track lifting and lining unit is also conventional and has flanged wheels running on main track 4, as well as lifting rollers and hooks adjustable to engage the main track rails. Ballast tamping assembly 10 succeeds track lifting and lining unit 9 in the operating direction and, in the illustrated embodiment, consists of four ballast tamping units mounted on machine frame 3 for displacement transversely to the direction of elongation, i.e. (as shown in FIG. 3) two inner tamping units 11 and two outer tamping units 12. The tamping units are transversely aligned and their arrangement and operation is more fully described in U.S. Pat. No. 5,031,542. As best shown in FIG. 2, each outer tamping unit comprises carrier frame 23, tamping tool carrier 20 vertically adjustably mounted on the carrier frame for vertical displacement along vertical guide means 20, and a pair of vibratory tamping tools 19 mounted on tamping tool carrier 20 for reciprocation in the direction of elongation. Auxiliary lifting device 14 is vertically adjustably mounted on carrier frame 23 of transversely displaceable tamping unit 12 for lifting switch rail 35 transversely spaced from machine frame 3. Auxiliary lifting device 14 comprises vertically adjustable rail engaging tool 38, and lifting drive 13 links auxiliary lifting device 14 to carrier frame 23. Operator's cab 16 is mounted on machine frame 3 within view of the operating tools to enable an operator to control the operation, reference system 17 generating the required track position correction data. Power plant 18 on the machine frame delivers the required power for all operating drives.

While FIG. 2 only illustrates an outer tamping unit 12, inner tamping units 11 are similarly constructed and also are equipped with carrier frame 23 whose vertical guide columns 22 vertically adjustably support tamping tool carrier 20 carrying a pair of vibratory tamping tools 19. Drive means 21 are linked to the pair of tamping tools for vibrating and reciprocating the tools and drive 24 is connected to tamping tool carrier 20 for lowering the tamping tool carrier and immersing the tamping tools in ballast 25 during the tamping tool operation. A common transverse guide 26 for carrier frames 23 of the two inner tamping units 11 is supported on machine frame 3 so that the inner tamping units may be transversely displaced. The transverse guide is also rotatable about a vertical axis (indicated in phantom lines in FIG. 2 and noted by a circular arrow) so that tamping tools 19 of the inner tamping units may be properly centered with respect to obliquely positioned ties 27.

As best shown in FIG. 3, carrier frames 23 of outer tamping units 12 are mounted at the free ends of elongated carrier beams 28 which extend generally in the direction of elongation of machine frame 3 and are pivoted at their opposite ends to machine frame 3 for pivoting about vertical axis 29. First pivotal drive 30 links each carrier beam to the machine frame for transversely displacing the carrier beam and the tamping unit mounted thereon. Second pivotal drive links carrier frame 23 to the carrier beam to enable the carrier frame to be pivoted about vertical axis 32 relative to the carrier beam to adjust the position of tamping tools 19 optimally relative to the rail and tie to be tamped. Furthermore, carrier beam 28 is telescopingly extensible by drive 33 which is linked to the telescoping parts of the carrier beam so as to enable the tamping unit to be properly positioned in the longitudinal direction. The free end of carrier beam 28 is supported in upper and lower slide bearings 34.

As shown in FIG. 2, vertical guide rail 37 on carrier frame 23 extends parallel to guide columns 22 for vertically adjustably guiding support frame 36 of auxiliary lifting device 14 and this support frame is linked to lifting drive 13. Rail engaging tool 38 of the auxiliary lifting device is comprised of a pair of cooperating flanged rollers 39 and drive 62 links the rail engaging tool to support frame 36 so that flanged rollers 39 may be pivoted into engagement with the rail head of branch track rail 35. A bracket on auxiliary lifting device support frame 36 supports double-flanged roller 40 and is vertically adjustable with the auxiliary lifting device by lifting drive 13 for engagement with switch rail 35 so that tamping unit 12 may be properly centered over the rail during the lifting and tamping operation.

Furthermore, support jack 15 is mounted on carrier frame 23 for adjustment parallel to vertical guide columns 22, the jack including support plate 43 for engagement with ballast 25 upon vertical adjustment of the jack. The support jack is arranged on bracket 42 transversely to the direction of elongation laterally adjacent one of the tamping tools 19 on a side tamping unit 12 facing away from machine frame 3. Support jack 15 comprises hydraulic drive 41 including hydraulic fluid pressure control valve 44 for vertically adjusting support plate 43 parallel to vertical guide columns 22, the pressure in the jack being selectively adjusted by control valve 44. Control 45 in operator's cab 16 enables support jack 15 to be automatically operated in conjunction with the vertical adjustment of tamping tool carrier 20 when tamping tools 19 are immersed in ballast 25. Furthermore, lifting drive 6 linking lifting and lining unit 9 to machine frame 3 and lifting drive 13 linking auxiliary lifting device 14 to carrier frame 23 are operable synchronously and under the same pressures.

In a typical switch work operation diagrammatically illustrated in FIG. 3, switch tamper 1 runs on main track 4 in the operating direction indicated by arrow 5 and tamps the main track with three tamping units (one outer tamping unit 12 at the field side of one main track rail and the two inner tamping units 11 at the gage sides of both main track rails) while the other outer tamping unit 12 has been transversely displaced for synchronous tamping of branch track rail 35 so that the switch may be fixed in the geometrically correct position. (The final tamping of the branch track is subsequently effected in a separate operation with a tamper running on the branch track.) Auxiliary lifting device 14 on the other outer tamping unit 12 is guided on branch track rail 35 by double-flanged roller 40 so that it automatically follows this rail while no pressure is supplied to pivoting drive 30 so that the same remains inoperative during the tamping operation. Sufficient pressure is supplied to lifting drive 13 of the auxiliary rail lifting device to press double-flanged roller 40 against rail 35. However, auxiliary rail lifting device 14 could also be used without double-flanged roller 40. Lifting rollers 39 of rail engaging tool 38 are engaged with the rail head by pivoting drive 62 and remain engaged while support jack 15 is lifted after each tamping operation synchronously with tamping tool carrier 20 and is lowered again with the tamping tool carrier at the succeeding tamping operation, i.e. at each successive tie 27. The support force is adjusted according to the solidity and general condition of the surface of ballast 25 by operating pressure control valve 44. Lifting drives 6 and 13 are then synchronously operated with the same pressure to raise main track 4 and branch rail 35 simultaneously and the ballast is tamped under raised tie 27 at the branch rail. After tamping, tamping tool carrier 20 and support jack 15 are raised and the pressure in lifting drives 6 and 14 is released. The machine is then advanced to the succeeding tie.

FIGS. 4 and 5 illustrate another embodiment of the auxiliary rail lifting device. This auxiliary lifting device 46 comprises support frame 52 vertically adjustable on carrier frame 55 of tamping unit 56 by lifting drive 54 for the auxiliary lifting device. The support frame straddles switch rail 50 to be lifted and engages ballast 53 upon vertical adjustment thereof. Further drive 51 is mounted on support frame 52 for vertically adjusting rail engaging tool 47 consisting of a pair of cooperating lifting hooks 48. Pivoting drive 49 is linked to the lifting hooks for engaging the hooks with the head of rail 50 and for disengaging them therefrom. Gliding shoe 58 extends from support frame 52 and is vertically displaceably guided in guide rail 57 and a lug projecting from the gliding shoe is linked to lifting drive 54 for vertically displacing auxiliary lifting device 46.

As indicated in FIG. 5 by the position of tamping tools 59 and vertical guide columns 60 for the tamping tool carrier, carrier frame 55 of tamping unit 56 is transversely adjustable by pivoting about an axis extending in the direction of elongation of the machine frame and guide rail 57 of auxiliary lifting device 46 is correspondingly mounted on carrier frame 55 for pivoting about axis 61 extending in the direction of elongation perpendicularly to vertical guide columns 60. This enables the auxiliary rail lifting device to be positioned perpendicularly on ballast 53 for proper support thereon, regardless of the angle of carrier frame 55 of the tamping unit relative to the ballast bed. The pivoting of auxiliary rail lifting device 46 about axis 61 may be effected by a pivoting drive linked thereto (not shown) or pivoting axis 61 may be so positioned relative to the point of gravity of the auxiliary rail lifting device that the same will be pivoted automatically into its vertical position.

What is claimed is:

1. A switch tamping machine comprising (a) a machine frame extending in a direction of elongation and supported on undercarriages for mobility on a track resting on ballast, (b) a track lifting and lining unit, (c) lifting and lining drives linking the track lifting and lining unit to the machine frame between the undercarriages, (d) at least one ballast tamping unit mounted on the machine frame for displacement transversely to the direction of elongation, the tamping unit comprising (1) a carrier frame, (2) a tamping tool carrier vertically adjustably mounted on the carrier frame for vertical displacement along vertical guide means, and (3) a pair of vibratory tamping tools mounted on the tamping tool carrier for reciprocation in the direction of elongation, (e) an auxiliary lifting device vertically adjustably mounted on the carrier frame of the transversely displaceable tamping unit, for lifting a switch rail transversely spaced from the machine frame, the auxiliary lifting device comprising (1) a vertically adjustable rail engaging tool, and (f) a lifting drive linking the auxiliary lifting device to the carrier frame.

2. The switch tamping machine of claim 1, further comprising a vertical guide on the carrier frame for vertically adjustably mounting the auxiliary lifting device thereon, the vertical guide extending parallel to the vertical guide means, and the auxiliary lifting device further comprising a drive for adjusting the rail engaging tool.

3. The switch tamping machine of claim 1, wherein the auxiliary lifting device further comprises a double-flanged roller vertically adjustable with the auxiliary lifting device by the lifting drive for engagement with the switch rail.

4. The switch tamping machine of claim 1, further comprising a support jack mounted on the carrier frame for adjustment parallel to the vertical guide means, the jack including a support plate for engagement with the ballast upon vertical adjustment of the jack.

5. The switch tamping machine of claim 4, wherein the support jack is arranged transversely to the direction of elongation laterally adjacent one of the tamping tools on a side of the tamping unit facing away from the machine frame.

6. The switch tamping machine of claim 4, wherein the support jack comprises a hydraulic drive including a hydraulic fluid pressure control valve.

7. The switch tamping machine of claim 4, further comprising a control for automatically operating the support jack in conjunction with the vertical adjustment of the tamping tool carrier.

8. The switch tamping machine of claim 1, wherein the lifting drive linking the lifting and lining unit to the machine frame and the lifting drive linking the auxiliary lifting device to the carrier frame are synchronously operable.

9. The switch tamping machine of claim 1, wherein the auxiliary lifting device further comprises a support frame vertically adjustable on the carrier frame by the lifting drive for the auxiliary lifting device, the support frame straddling the switch rail to be lifted and engaging the ballast upon vertical adjustment thereof, and a further drive mounted on the support frame for vertically adjusting the rail engaging tool.

10. The switch tamping machine of claim 9, wherein the auxiliary lifting device is mounted on the carrier frame for pivoting about an axis extending in the direction of elongation perpendicularly to the vertical guide means.

* * * * *